United States Patent [19]

Masuda et al.

[11] Patent Number: 4,765,289

[45] Date of Patent: Aug. 23, 1988

[54] VALVE DRIVING SYSTEM FOR INTERNAL COMBUSTION ENGINE

[75] Inventors: Shunji Masuda; Eiji Nakai, both of Hiroshima, Japan

[73] Assignee: Mazda Motor Corporation, Hiroshima, Japan

[21] Appl. No.: 105,730

[22] Filed: Oct. 7, 1987

[30] Foreign Application Priority Data

Oct. 16, 1986 [JP] Japan ..... 61-246084

[51] Int. Cl.[4] ..... F01L 1/34

[52] U.S. Cl. ..... 123/90.16; 123/90.17; 123/90.44

[58] Field of Search ..... 123/90.16, 90.17, 90.44, 123/90.46, 90.39, 90.41, 90.4

[56] References Cited

U.S. PATENT DOCUMENTS 4,534,323 8/1985 Kato et al. ..... 123/90.44
4,612,884 9/1986 Ajike et al. ..... 123/90.16
4,690,110 9/1987 Nishimura et al. ..... 123/90.17

FOREIGN PATENT DOCUMENTS 0058605 4/1986 Japan .

*Primary Examiner*—Willis R. Wolfe
*Assistant Examiner*—M. Macy
*Attorney, Agent, or Firm*—Fleit, Jacobson, Cohn & Price

[57] ABSTRACT

A valve driving system for an internal combustion engine having two intake valves and/or two exhaust valves for each cylinder, which includes a cam shaft formed with a pair of low speed cams and a high speed cam located at substantially the center part of the cam shaft, a pair of first rocker arms driven by the low speed cams respectively, each having a portion engaged with one of the valves, second rocker arms driven by the high speed cam and located between the first rocker arms, two oil pressure chambers formed in the second rocker arm and facing the respective first rocker arms, two plungers, each being provided in one of the oil chambers, two bores each being formed engageably with one of the plungers in one of the first rocker arms, an oil passage formed in the second rocker arm and communicated with both oil pressure chambers, and a control valve for controlling oil pressure fed to the oil passage in accordance with the engine operating condition.

9 Claims, 4 Drawing Sheets

VALVE DRIVING SYSTEM FOR INTERNAL COMBUSTION ENGINE

CROSS REFERENCE OF RELATED APPLICATIONS

The present invention relates generally to the subject matter of the following prior U.S. patent application: Ser. No. 855,436, filed Apr. 24, 1986, entitled "Variable Valve Mechanism For Internal Combustion Engines", now U.S. Pat. No. 4,690,110.

BACKGROUND OF THE INVENTION

The present invention relates to a valve driving system for an internal combustion engine, and more particularly to such a valve driving system capable of selecting one of a plurality of cams for driving intake valves and/or exhaust valves in accordance with engine rpm.

DESCRIPTION OF PRIOR ART

There is known an internal combustion engine which has two intake valves and/or two exhaust valves to take in greater amount of intake air and/or discharge greater amount of exhaust gas and which is suitable for operation at high engine rpm or high engine output.

However, since the cross-sectional area of the intake passage and/or the exhaust passage is large in this engine, intake air often passes through directly from the intake passage to the exhaust passage and the charging efficiency is inevitably decreased at low engine rpm, whereby the engine output is degraded.

In order to solve this problem, Unexamined Japanese Utility Model Publication No. 58605/1986 discloses a valve driving system for an internal combustion engine having two intake valves and two exhaust valves for each cylinder thereof. In this prior art system, there are provided a first rocker arm pivotally mounted on a rocker shaft and engaged with the respective intake valves for driving them under low speed engine operating condition in accordance with the movement of a low speed cam having a cam lobe suitable for low speed engine operation and, on the side of the first rocker arm, a second rocker arm pivotally mounted on the rocker shaft for driving the respective intake valves by engagement with the first rocker arm under high speed engine operating condition in accordance with the movement of a high speed cam having a cam lobe suitable for high speed engine operation and an engaging means for engaging the second rocker arm with the first rocker arm under high engine rpm and releasing the engagement between the second rocker arm and the first rocker arm under low engine rpm. For the respective exhaust valves, an identical valve driving mechanism is employed.

According to this prior art system, since the second rocker arm is not engaged with the first rocker arm at low engine rpm and it is engaged with the first rocker arm at high engine rpm, it is possible to drive the intake valves and exhaust valves in accordance with movement of the low speed cam under low engine rpm operating condition and drive the intake valves and exhaust valves in accordance with the high speed cam under high engine rpm operating condition, whereby the intake valves and exhaust valves can be opened and closed at timings determined in accordance with engine rpm.

However, in this prior art system, since the second rocker arm is arranged on the side of the first rocker arm and the high speed cam is not positioned at a center portion of both intake valves, an undesired force which produces a moment of force in a plane other than the plane perpendicular to the axis of the rocker shaft acting on the rocker shaft, whereby the friction resistance between the rocker shaft and the second rocker arm is increased and the durability of the valve driving system is lowered since the second rocker arm and the rocker shaft are often worn nonuniformly.

SUMMARY OF THE INVENTION

It is therefore the object of the present invention to provide a valve driving system for an internal combustion engine having two valves for one or both of an intake port and an exhaust port for each cylinder thereof which has high durability and simple structure.

According to the present invention, the above and other objects can be accomplished by a valve driving system for an internal combustion engine in which two valves are provided for one or both of an intake port and an exhaust port in each cylinder, said valve driving system comprising cam shaft means formed with two types of cams of different shapes, one of which consists of a pair of low speed cams located at the end portion of said cam shaft means and the other of which consists of a high speed cam located at substantially the center part of said cam shaft means, a pair of first rocker arm means driven by said low speed cams respectively, each having a portion engaged with one of said valves, second rocker arm means driven by said high speed cam and located between said first rocker arm means, a pair of oil pressure chamber means formed in said second rocker arm means, a pair of plunger means each being provided in one of said oil pressure chamber means, a pair of bores each being formed engageably with one of said plunger means in one of said first rocker arm means, oil passage means formed in said second rocker arm means and communicated with said oil pressure chamber means and control means for controlling oil pressure fed to said oil passage means in accordance with engine operating condition.

The above and other objects and features of the present invention will become apparent from the following description made with reference to the accompanying drawings.

DESCRIPTION OF THE PREFERRED EMBODIMENTS

Figure 1:
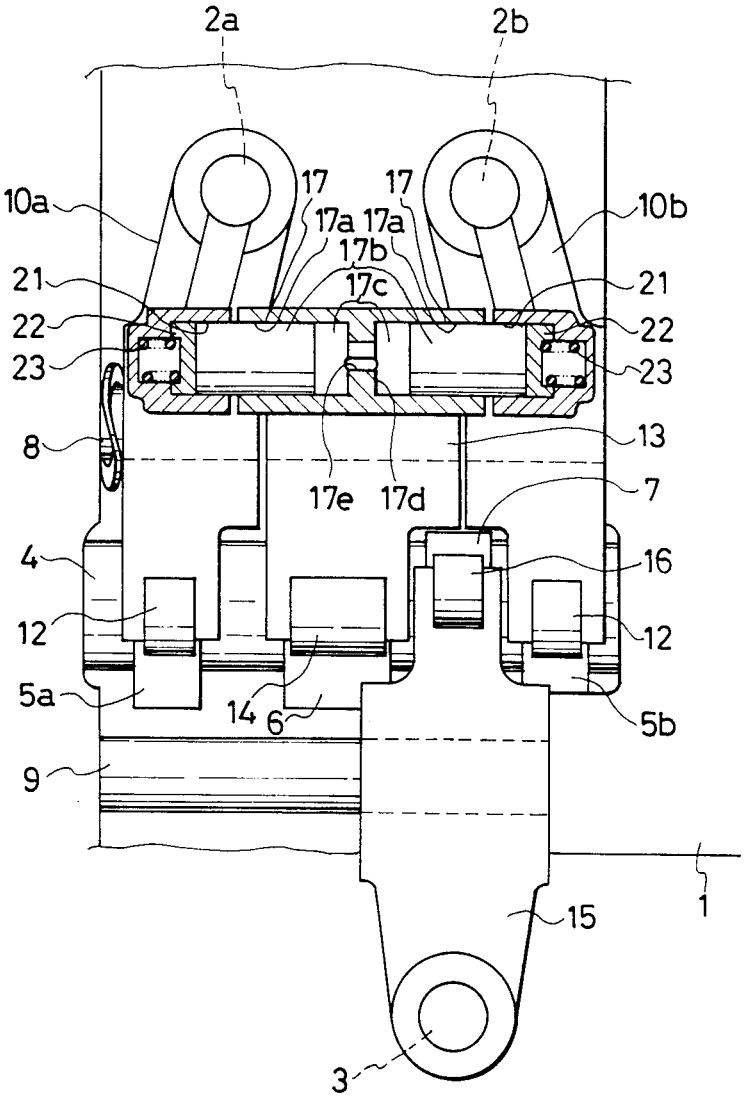
FIG. 1 is a schematic drawing showing a plan view of a valve driving system for an internal combustion engine which is an embodiment of the present invention.
Figure 2:
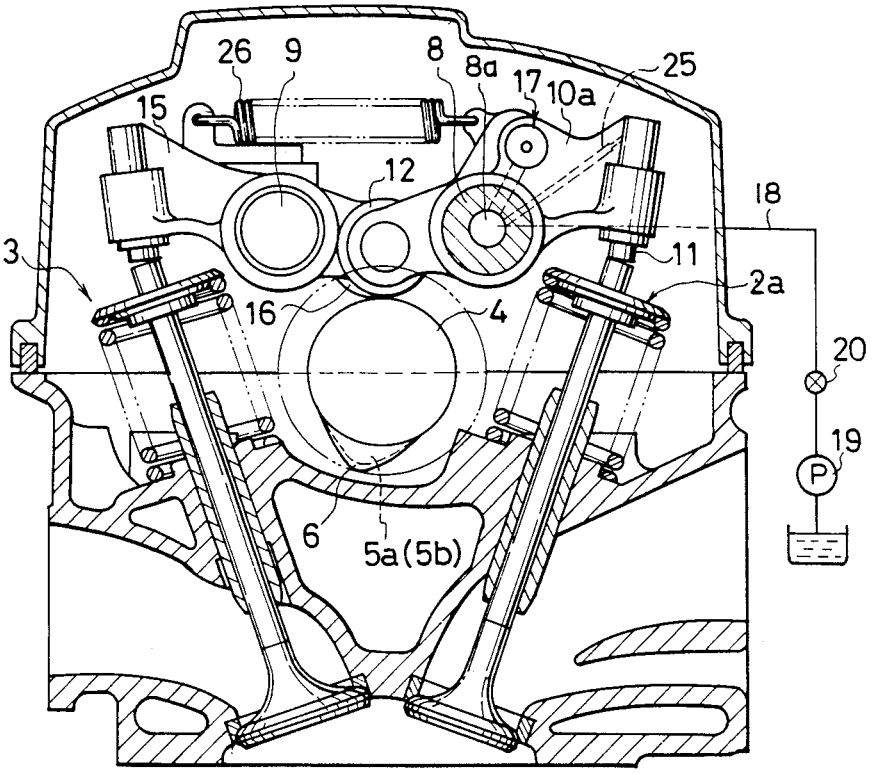
FIG. 2 is a schematic drawing showing a side view of a valve driving system for an internal combustion engine which is an embodiment of the present invention.

Referring to FIGS. 1 and 2, there is shown one cylinder of an internal combustion engine having a plurality of cylinders formed below a cylinder head 1 and each cylinder has two intake valves 2*a* and 2*b* for opening and shutting respective intake ports and one exhaust valve 3 for discharging exhaust gas from the cylinder.

Over the cylinder head 1, a camshaft 4 is provided between the intake valves 2*a* and 2*b* and the exhaust valve 3, and is formed with a pair of low speed cams 5*a* and 5*b* and a high speed cam 6. The high speed cam 6 is located at substantially the center portion between the low speed cams 5*a* and 5*b*. The high speed cam 6 has a cam lobe which is larger than the cam lobes in the low speed cams 5*a* and 5*b* so that the high speed cam 6 can provide greater cam lift and cam open period than the low speed cams 5*a* and 5*b*. A cam 7 for driving the exhaust valve 3 is provided between one of the low speed cams 5*b* and the high speed cam 6.

Further, there are arranged a first rocker shaft 8 on the side of the intake valves 2*a* and 2*b* with respect to the camshaft 4 and a second rocker shaft 9 on the side of the exhaust valve 3 with respect to the camshaft 4. There are pivotally mounted on the first rocker shaft 8 first rocker arms 10*a* and 10*b* for driving the intake valves 2*a* and 2*b* respectively. The respective first rocker arms 10*a* and 10*b* are arranged so that they are engaged with the stem of the intake valves 2*a*, 2*b* at one end thereof and that they are engaged with the low speed cams 5*a* and 5*b* at the other end. At one end of each of the first rocker arms 10*a* and 10*b*, a hydraulic lash adjustor 11 is provided so that the end of each of the first rocker arms 10*a* and 10*b* is engaged with the stem of one of the intake valves 2*a* and 2*b* without any lash between them and at the other end of each of the first rocker arms 10*a* and 10*b*, there is provided roller cam followers 12 for reducing sliding friction between the end of each of the first rocker arms 10*a*, 10*b* and one of the low speed cams 5*a*, t*b*. An oil passage 8*a* is formed in the first rocker shaft 8 for feeding oil to the hydraulic lash adjustor 11 and an engaging device (explained later). The reference numeral 25 designates an oil passage communicated with the oil passage 8*a* for feeding oil to the hydraulic lash adjustors 11.

A second rocker arm 13 for transmitting the movement of the high speed cam 6 to the respective first rocker arms 10*a* and 10*b* is pivotally mounted on the first rocker shaft 8 at substantially the center portion between the first rocker arms 10*a* and 10*b* and it is engaged with the high speed cam 6 at one end thereof. There is provided a spring 26 for pressing the end of the second rocker arm 13 against the high speed can 6 and preventing the second rocker arm 13 from hitting the high speed cam 6 at low engine rpm. At the end of the second rocker arm 13, there is provided a roller cam follower 14 for reducing sliding friction between the end of the second rocker arm 13 and the high speed cam 6. The axial length of the roller cam follower 14 is determined larger than that of the roller cam follower 12.

Moreover, a third rocker arm 15 for transmitting the movement of the cam 7 for driving the exhaust valve 3 to the exhaust valve 3 is pivotally mounted on the second rocker shaft 9 and at one end thereof, a roller cam follower 16 is provided for reducing sliding friction between the the end of the third rocker arm 15 and the cam 7.

In order to releasably connect the first rocker arms 10*a* and 10*b* and the second rocker arm 13, there are provided a pair of engaging devices 17. Each of the engaging devices 17 comprises a cylinder bore 17*a* formed in the second rocker arm 13, a plunger 17*b* slidably received in the cylinder bore 17*a* and a oil pressure chamber 17*c* formed by the cylinder bore 17*a* and the plunger 17*b*. There is provided a wall 17*d* for separating the oil pressure chamber of one engaging device 17 from that of the other between the oil pressure chambers 17*c* of the respective engaging devices 17. An oil passage 17*e* for feeding oil to the respective oil pressure chambers 17*c* opens to the respective oil pressure chambers 17*c* at the wall 17*d*. The oil passage 17*e* is communicated with the oil passage 8*a* formed in the first rocker shaft 8. It is preferable that the oil passage 17*e* be formed by a drill so as to be oblique toward the upstream direction of the oil passage 8*a*, so that oil can be easily introduced into the oil pressure chamber 17*c*. Each of the oil pressure chambers 17*c* is communicated with an oil pump 19 through an oil passage 17*e* formed in the second rocker arm 13, the oil passage 8*a* being a formed in the rocker shaft 8 and connected with an oil passage 18. There is provided within the oil passage 18 a valve 20 for opening and closing the oil passage 18 in accordance with engine rpm. Bores 21 for receiving the plunger 17*b* are formed in the respective first rocker arm 10*a* and 10*b* and plunger receivers 22 are provided in the respective bores 21 so that the respective plungers are maintained in abutting engagement with it. In each of the bores 21, there is a spring 23 which biases the plunger 17*b* outwards through the plunger receiver 22. At low engine rpm, the opening of the valve 20 is reduced to reduce the amount of oil fed to the oil pressure chamber 17*c* and the oil pressure in the oil pressure chamber 17*c* becomes low, whereby the plunger 17*b* is forced to be moved outside of the bore 21 by the spring 23 and to be received by the wall 17*d* in the cylinder bore 17*a* and the second rocker arm 13 gets unengaged with the first rocker arms 10*a* and 10*b*. On the other hand, at high engine rpm, the valve opens the oil passage 18 and the oil pressure in the respective oil pressure chambers 17*c* is increased to become larger than pressure by the spring 23, whereby the respective plungers 17*b* get received in the bores 21 of the first rocker arms 10*a* and 10*b* and the second rocker arm 13 get engaged with the respective first rocker arms 10*a* and 10*b*.

According to the above described embodiment, since the second rocker arm 13 is not engaged with the first rocker arms 10*a* and 10*b* at low engine rpm, the movement of the low speed cams 5*a* and 5*b* is transmitted to the intake valves 2*a* and 2*b* by the first rocker arms 10*a* and 10*b* and the intake valves 2*a* and 2*b* are driven by the low speed cams 5*a* and 5*b*, and, on the other hand, at high engine rpm, since the second rocker arm 13 is engaged with the first rocker arms 10*a* and 10*b* the movement of the high speed cam 6 is transmitted to the intake valves 2*a* and 2*b* through the second rocker arm 13 and the first rocker arms 10*a* and 10*b* and the intake valves 2*a* and 2*b* are driven by the high speed cam 6.

Figure 3A:
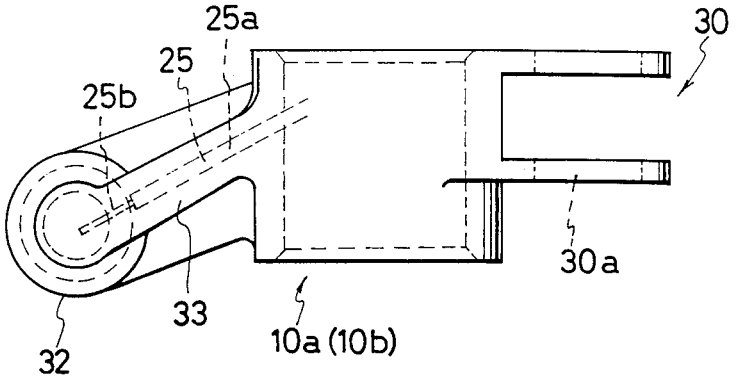
FIG. 3A is a schematic drawing showing a plan view of a rocker arm engaged with an intake valve, which is used in an embodiment of the present invention.
Figure 3B:
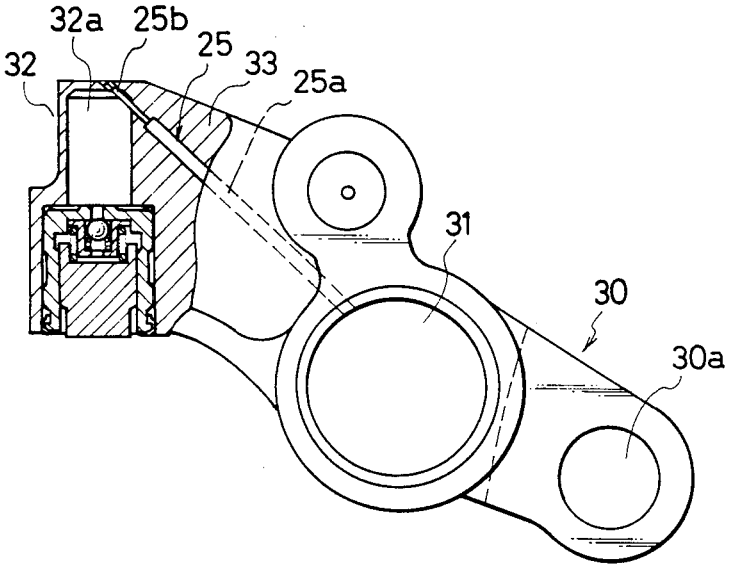
FIG. 3B is a schematic drawing showing a side view of a rocker arm engaged with an intake valve, which is used in an embodiment of the present invention.

Referring to FIGS. 3A and 3B, there are shown details of the first rocker arms 10*a*, 10*b* used in this embodiment. In FIGS. 3A and 3B, the reference numeral 30 designates a fork portion for supporting the roller cam follower 12 and there is provided at the fork portion a bore 30*a* for engaging a shaft for supporting the roller cam follower 12. Further, there are provided a bore 31 in which the first rocker shaft 8 extends and a housing 32 for the hydraulic lash adjustor 11. A portion in the vicinity of the bore 31 and the housing 32 are connected by a reinforcing rib 33, extending substantially straight, in which the oil passage 25 for feeding oil to the hydraulic lash adjustor 11 is formed. The oil passage 25 consists of a bore 25*a* having large diameter and a bore 25*b* having small diameter and is formed by a drill so that the bore 25*a* is drilled from the side of the rocker shaft bore 31 and that the bore 25*b* is drilled from the side of the housing 32 through a reservoir chamber 32*a*, since it is difficult to form the oil passage 25 over the whole length by a drill having a small diameter although it is preferable for effectively removing air from the reservoir chamber 32*a* that the diameter of the bore be small.

Figure 4A:
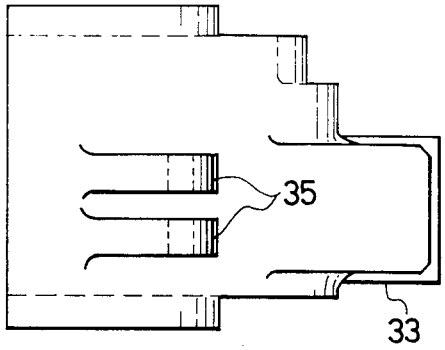
FIG. 4A is a schematic drawing showing a plan view of a rocker arm driven by a high speed cam, which can be used for the present invention.
Figure 4B:
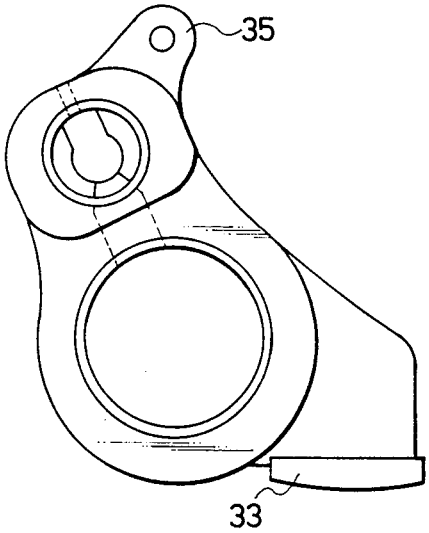
FIG. 4B is a schematic drawing showing a side view of a rocker arm driven by a high speed cam, which can be used for the present invention.
Figure 4C:
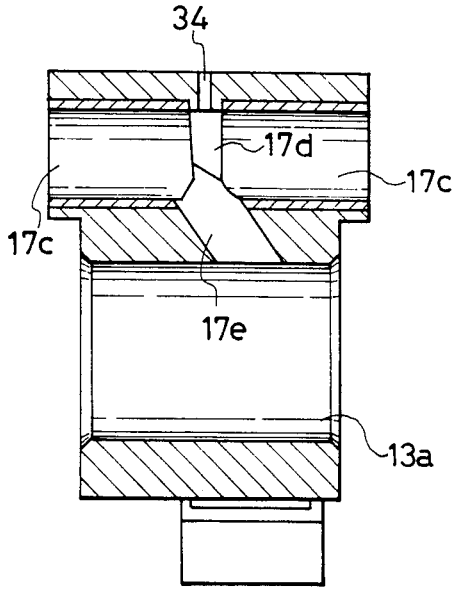
FIG. 4C is a schematic drawing showing a partial cross sectional view of a rocker arm driven by a high speed cam, which can be used for the present invention.

FIGS. 4A to 4C show details of a second rocker arm 13 which is somewhat different from that used in the above described embodiment in the structure of the engaged portion with the high speed cam 6, although the basic structure is the same as that in the above described embodiment so that corresponding parts are designated by the same numerals as in the previous embodiment. In FIGS. 4A to 4C, the end of the second rocker arm is formed with a slipper 33 and is directly and slidably engaged with the high speed cam 6 in place of interposing the roller cam follower 14 between them in order to prevent the weight of the system from increasing, since the end portion of the second rocker arm 13 is engaged with the high speed cam 6 only at high rpm, while the end of each of the first rocker arms 10*a* and 10*b* is engaged under normal engine operating condition. The main body of the second rocker arm 13 is usually made of aluminum alloy but it is preferable to make the slipper 33 of special cast iron or ceramic for improving wear resistance. As shown in FIG. 4C, the oil passage 17*e* communicates with a bore 13*a* formed in the second rocker arm 13 for extending the rocker shaft 8 therein to the wall 17*d* for separating the respective oil pressure chambers 17*c*, and is formed by a drill so as to extend obliquely and upwardly toward the downstream direction of oil in order to make it easier to feed oil to the respective oil pressure chambers 17*c* and increase the oil pressure in the oil pressure chambers 17*c* to a predetermined pressure as soon as the valve 20 is opened. Further, there is provided a hole 34 for removing air from the respective oil pressure chambers 17*c*. The reference numeral 35 designates a supporting portion for securing the spring 26 for pressing the second rocker arm 13 against the high speed cam 6.

According to the present invention, since forces produced by the high speed cam are transmitted from the high speed cam to the respective intake valves through substantially symmetrical paths with respect to the high speed cam, no moment of a force acts on the rocker shaft in a plane other than the plane perpendicular to the axis of the rocker shaft and the second rocker arm and the rocker shaft can be prevented from being nonuniformly worn, whereby the durability of the valve driving system can be remarkably improved. Further, since the engaging devices for engaging the second rocker arm with the respective rocker arms are located within the second rocker arm, oil can be fed to the respective engaging devices by a single oil passage, whereby the structure of the valve driving system can be made simple.

The present invention has thus been shown and described with the reference to the specific embodiments. However, it should be noted that the present invention is in no way limited to the details of the described arrangements but changes and modifications may be made without departing from the scope of the appended claims.

For example, although the internal combustion engine is provided with two intake valves and one exhaust valve in the above described embodiments, the present invention can be applied to an engine having two intake valves and two exhaust valves. Further, although the intake valves are driven by the low speed cams or the high speed cam selectively in accordance with engine rpm in the above described embodiments, two exhaust valves can be driven in accordance with the present invention.

Furthermore, although the oil passages 17*e* and 25 are communicated with the oil passage 8*a* in the above described embodiment, they can be independent passages for controlling the oil pressure in them independently. In such case, it is very advantageous to provide the oil passage 25 for feeding oil to the lash adjustor 11 in each of the first rocker arms 10*a* and 10*b* as shown in the above described embodiment.

We claim:

1. A valve driving system for an internal combustion engine in which two valves are provided for one or both of an intake port and an exhaust port in each cylinder, said valve driving system comprising cam shaft means formed with two types of cams of different shapes, one of which consists of a pair of low speed cams located at the end portion of said cam shaft means and the other of which consists of a high speed cam located at substantially the center part of said cam shaft means, a pair of first rocker arm means driven by said low speed cams respectively each having a portion engaged with one of said valves, second rocker arm means having a bore therein and driven by said high speed cam and located between said first rocker arm means, a pair of oil pressure chamber means formed in said second rocker arm means, a pair of plunger means each being provided in one of said oil pressure chamber means, two bores each being formed engageably with one of said plunger means in each of said first rocker arm means, oil passage means formed in said second rocker arm means and communicated with said two oil pressure chamber means and control means for controlling oil pressure fed to said oil passage means in accordance with engine operating condition.

2. A valve driving system in accordance with claim 1 which further includes a rocker shaft means for pivotally mounting said first and second rocker arm means and in which each of said oil pressure chamber means has a cylindrical bore in which said plunger means can move slidably and in which a bore is formed in said second rocker arm means in which said rocker shaft means extends and which further includes wall means for separating said oil pressure chamber means and receiving said plunger means and in which said oil passage means formed in the second rocker arm means is communicated with the respective cylindrical bores and said bore formed in the second rocker arm means and opening at said wall means.

3. A valve driving system in accordance with claim 2 which further includes an oil passage means formed in said rocker shaft means and in which said oil passage means is connected with said oil passage means formed in said second rocker arm means at the inner surface of said bore formed in the second rocker arm means.

4. A valve driving system in accordance with claim 1 which further includes lash adjusting means for adjusting lash between the end of said first rocker arm means and said intake valve means for the end portion of each of said first rocker arm means and oil passage means formed in said first rocker arm means for feeding oil to said lash adjusting means.

5. A valve driving system in accordance with claim 4 which further includes a bore formed in said first rocker arm means for being mounted on said rocker shaft means, a housing for said lash adjusting means and a rib means extending substantially straight for connecting said housing and a portion in the vicinity of said bore and in which said oil passage means is formed in said rib means.

6. A valve driving system in accordance with claim 1 which further includes roller cam follower means located at a position where said first rocker arm means is engaged with said low speed cam.

7. A valve driving system in accordance with claim 1 in which one cam shaft means is located over a cylinder head and in which said internal combustion engine has two intake valves and one exhaust valve and which further includes a cam for driving said exhaust valve means.

8. A valve driving system in accordance with claim 1 which further includes spring means for pressing the end of said second rocker arm means against said high speed cam.

9. A valve driving system for an internal combustion engine having first and second intake valve means and one exhaust valve means, said valve driving system comprising one cam shaft means located over a cylinder head, a first low speed cam, a high speed cam, an exhaust cam and a second low speed cam which are arranged in order in the axial direction of said cam shaft means, first rocker arm means driven by said first low speed cam and engaged with said first intake valve means, second rocker arm means driven by said high speed cam and not engaged with any of said valve means, third rocker arm means driven by said exhaust cam and engaged with said exhaust valve means, fourth rocker arm means driven by said second low speed cam and engaged with said second intake valve means, said first, second and fourth rocker arm means having bores for receiving rocker shaft means and being swingably mounted on said rocker shaft means respectively, said second rocker arm means being located between said first and fourth rocker arm means and formed with a pair of oil pressure chamber means extending in the axial direction of said cam shaft means therein, each of said oil pressure chamber means having an opening facing one of said first and fourth rocker arm means and plunger means movable into and engageable with one of said first and fourth rocker arm means, wall means located between said respective oil pressure means for separating them and restricting the movement of said respective plunger means, first oil passage means formed in said second rocker arm means and communicated with said respective oil pressure chamber means and the inside of said rocker shaft means, each of said first and fourth rocker arm means being formed with a bore therein for receiving said plunger means, said bore having therein return spring means for biasing said plunger means to the outside thereof, lash adjusting means located at the ends of said first and fourth rocker arm means where they are engaged with said first and second intake valve means respectively for adjusting lash between the ends of said first and fourth rocker arm means and said first and second intake valve means, said lash adjusting means being in housing means, second oil passage means formed in said first and fourth rocker arm means for feeding oil to said housing means, said second oil passage means being communicated with the inside of said rocker shaft means and said housing means and formed in rib means extending substantially straight and connecting said housing means and a portion of said first and fourth rocker arm means in the vicinity of said bore for receiving said rocker shaft means, spring means for pressing the end portion of said second rocker arm means against said high speed cam and control means for controlling oil pressure in said rocker shaft means so as to be low engine rpm and high at high engine rpm.

* * * * *